US007104421B2

(12) United States Patent
Eckhardt, Jr. et al.

(10) Patent No.: US 7,104,421 B2
(45) Date of Patent: Sep. 12, 2006

(54) GOLF BALL TEEING DEVICE

(75) Inventors: Franz Charles Eckhardt, Jr., Sassafras (AU); Christopher Patrick Heffernan, Mentone (AU); James Francis Howe, Mentone (AU)

(73) Assignee: Tee Up Pty Ltd., Sassafras (AU)

( * ) Notice: Subject to any disclaimer, the term of this patent is extended or adjusted under 35 U.S.C. 154(b) by 0 days.

(21) Appl. No.: 10/786,397

(22) Filed: Feb. 25, 2004

(65) Prior Publication Data

US 2004/0224782 A1 Nov. 11, 2004

Related U.S. Application Data

(62) Division of application No. 10/312,072, filed as application No. PCT/AU01/00540 on May 11, 2001, now abandoned.

(30) Foreign Application Priority Data

Jul. 26, 2000 (AU) ..... PQ9006

(51) Int. Cl.
*B65G 59/00* (2006.01)

(52) U.S. Cl. ..... 221/289; 221/290; 221/298; 473/133; 473/137

(58) Field of Classification Search ..... 473/135, 473/132, 133, 137; 221/174, 289, 290, 298, 221/299

See application file for complete search history.

(56) References Cited

U.S. PATENT DOCUMENTS 1,598,971 A 9/1926 Kenyon
1,850,174 A 3/1932 Joseph
1,888,256 A 11/1932 Baumgartner
1,952,113 A 3/1934 Beckett
1,965,697 A 7/1934 Gardner et al.
2,127,282 A 8/1938 Beckett
2,198,968 A 4/1940 Jewett
2,450,205 A 9/1948 Shouse
2,675,237 A * 4/1954 Willcox ..... 473/136
2,711,321 A 6/1955 McGraw, Sr.
2,838,313 A * 6/1958 Mozel ..... 473/136
3,599,983 A * 8/1971 Melton ..... 473/137
3,966,213 A 6/1976 Bradley (Continued)

FOREIGN PATENT DOCUMENTS

FR 2727321 1/1996

(Continued)

OTHER PUBLICATIONS

Derwent Abstract Accession No. 96-316737/32, JP 08141128 A (Hasegawa), Jun. 4, 1996.

*Primary Examiner*—David H. Bollinger
(74) *Attorney, Agent, or Firm*—Volpe and Koenig, P.C.

(57) ABSTRACT

A golf ball teeing device comprising, a platform having an upper surface, an opening in the platform, a tee for a golf ball the tee being arranged for reciprocal movement with respect to the opening between a lower position where the top of the tee is at a level below the upper surface of the platform to an upper position where the top of the tee is above upper surface of the platform, and golf ball deliver means arranged to load a golf ball on top of the tee when it is in the lower position, wherein the golf ball is at a level below the upper surface of the platform when it is loaded onto the tee by the golf ball delivery means.

2 Claims, 11 Drawing Sheets

U.S. PATENT DOCUMENTS

| | | | | |
|---|---|---|---|---|
| 4,602,789 | A | 7/1986 | Chung | |
| 5,016,886 | A | 5/1991 | Gould | |
| 5,022,657 | A | 6/1991 | Bussiere et al. | |
| 5,282,629 | A | 2/1994 | Eckstein | |
| 5,326,107 | A | 7/1994 | Park | |
| 5,356,148 | A | 10/1994 | Elder, Jr. | |
| 5,611,737 | A | 3/1997 | Rau et al. | |
| 5,624,325 | A * | 4/1997 | Smith | 473/137 |
| 5,916,033 | A | 6/1999 | Doherty | |
| 5,971,862 | A | 10/1999 | Yates | |
| 6,174,243 | B1 * | 1/2001 | Choi | 473/137 |
| 2003/0162598 | A1 * | 8/2003 | Eckardt, Jr. et al. | 473/135 |
| 2005/0020370 | A1 * | 1/2005 | Howe et al. | 473/135 |

FOREIGN PATENT DOCUMENTS

| | | | |
|---|---|---|---|
| GB | 2224216 | A | 5/1990 |
| GB | 2231803 | A | 11/1990 |
| WO | 8901354 | | 2/1989 |
| WO | 0207827 | | 1/2002 |

* cited by examiner

GOLF BALL TEEING DEVICE

CROSS REFERENCE TO RELATED APPLICATION(S)

This application is a divisional of U.S. patent application Ser. No. 10,312,072, filed Mar. 4, 2003 now abandoned, which is incorporated by reference as if fully set forth.

FIELD OF INVENTION

This invention relates to devices for teeing up golf balls.

BACKGROUND

Many golfers use the facilities at golf ball driving ranges to practice their driving. Typically this may involve renting a bucket full of balls which are driven one by one onto the driving range. After driving each ball, the golfer must bend over, take a golf ball out of the bucket and place it on a tee. This operation is repeated until the whole bucket full of balls, which may typically number 50 to 100 balls, is emptied. As a result, the golfer must bend down 50 to 100 times depending upon the number of golf balls he has hired.

For people with bad backs, the continuous bending associated with setting up a large number of golf balls on a tee can be quite painful. Even if the golfer does not have a bad back, the time spent bending over and placing the ball is generally not considered to be enjoyable. Given that the purpose of golf is to relax and enjoy oneself, the removal of the requirement to bend down and replace each ball on a tee at a driving range should enhance the enjoyable nature of the experience.

With this purpose in mind, various approaches have been devised for automatically setting up golf balls on a golf tee. However, they all suffer from one or more disadvantages. For example, they may include mechanisms which are relatively complex in operation. As a result their cost of manufacture, which is generally related to the degree of complexity, can be high.

Some mechanisms in operation appear to suffer from a lack of reliability in relation to the accurate placement of a ball on a tee over long periods of time.

Some mechanisms require electrical power to drive the operation of the mechanism. Apart from requiring costly electrical machinery and wiring on the golf driving range, such mechanisms are unworkable at times when there is an interruption of electrical power. Furthermore, because they are generally in a location which is unprotected from the weather, particular care needs to be taken to ensure the safety of a golfer by protecting and insulating the electrical components.

The present invention seeks to obviate or minimize one or more of the aforesaid disadvantages.

SUMMARY

In one aspect the invention provides a golf ball teeing device comprising: a platform having an upper surface, an opening in the platform, a tee for a golf ball arranged for reciprocal movement through the opening between a lower position where the top of the tee is at a level below the upper surface of the platform to an upper position where the top of the tee is above the upper surface of the platform, and golf ball delivery means arranged to load a golf ball on top of the tee when it is in the lower position, wherein the golf ball lies beneath the upper surface of the platform when it is loaded on to the tee by the golf ball delivery means.

The platform may be constructed so that it may support a golfer standing thereon.

Suitably the device includes actuation means for placing a golf ball on the tee in response to actuation by a golfer. The actuation means may comprise a switch, lever or push button. In one aspect the actuation means may be foot operated. It may be provided on the platform.

In a preferred aspect, the actuation means may provide the driving force for operating the device i.e. the pressure of a golfer's foot or manual manipulation of the actuation means may be all that it is required to operate the device without the requirement for an independent source of motor power such as electricity, pneumatic power, hydraulic power or other form of energy.

The actuation means may be associated with a lever for raising and lowering the golf tee. In turn, the lever may be pivotally mounted at a first position along its length. The first position may be near one of the ends of the lever. The arrangement of the lever may be such that upwards movement of the lever at a second position along its length serves to move the tee upwardly through the opening.

Biasing means may be provided in association with the lever to bias the lever upwards so that the tee is normally in its upper position. The biasing means may comprise a resilient member such as a spring.

Thus the actuation means may operate by applying downwards force on the lever to move the tee to the lower position. The downwards force may comprise the foot of a golfer pushing down on the actuation means. When the downwards force is stopped the tee may automatically move back to its upper position.

Ball control means may be associated with the movement of the lever. The ball control means may act to supply a single ball onto the top of the tee. The ball control means may be associated with a trackway for delivering golf balls. Thus the ball control means may be arranged to operate so that a single ball may be allowed to roll from the trackway onto the golf tee in its lower position. At the same time, the ball control means may act to prevent any other balls on the trackway moving onto the tee until a further reciprocal movement of the tee has been initiated.

The device suitably includes damping means for damping the upward movement of the tee as it moves from the lower position to the upper position. The damping means may comprise a pneumatic cylinder. The damping means may be arranged to damp the movement of the lever and hence the tee moved thereby.

Height adjustment means may be provided in association with the device. The height adjustment means may be arranged so that the upper position of the tee can be varied. The height adjustment means may operate by limiting the upwards movement of the lever as it pushes the tee upwards. The height adjustment means may include a stop member which limits the upward movement of the lever.

The stop member may comprise a ramp. It may be arranged to slide parallel to the platform to adjust the height of the tee. Suitably, a height adjustment lever may be provided in association with the platform for setting the height of the tee. It may be arranged to move the ramp to an appropriate position for setting a desired height.

Suitably the device includes ball delivery means for delivering balls single file to the trackway. Such ball delivery means may include a feeder tray for receiving balls and delivering them to the trackway in single file.

Thus in a further aspect of the invention there is provided a feeder tray for balls comprising: a base member having a pair of opposed sloping surfaces for receiving balls, a ball trackway provided between the sloping surfaces and arranged to receive in single file balls rolling down the sloping surfaces into the trackway, an outlet for balls from the ball trackway, a wall for retaining balls in the feeder tray provided around the periphery of the feeder tray, wherein the ball trackway slopes downwardly towards the outlet.

Suitably the ball trackway slopes downwardly in a direction approximately at right angles to the direction of the slope of each of the opposed sloping surfaces.

The trackway referred to above may constitute a continuation of the trackway described with reference to the ball control means. Furthermore, the sloping surfaces may themselves comprise part of the wall.

Suitably, the feeder tray is provided with an outlet for feeding balls single file to an elongate trackway. The elongate trackway may include a series of bends. The elongate trackway may act as a storage medium for a large number of balls waiting to be fed into the trackway and ball control means of the golf ball teeing device of the invention.

In yet another aspect the invention provides a feeder tray for balls comprising: a hopper having an open mouth arranged to funnel balls dumped through the open mouth into a ball entry area of an alignment tray, an exit chute arranged to deliver balls single file along a downward slope, a tray floor for the alignment tray sloping downwardly from the ball entry area to the exit chute, and ball flow control means on the tray floor, wherein the ball flow control means are arranged to slow the rate of travel of a proportion of balls rolling down the tray floor into the exit chute.

Preferred aspects of the invention will now be described with reference to the accompanying drawings.

BRIEF DESCRIPTION OF THE DRAWING(S)

DETAILED DESCRIPTION OF THE PREFERRED EMBODIMENT(S)

Figure 1:
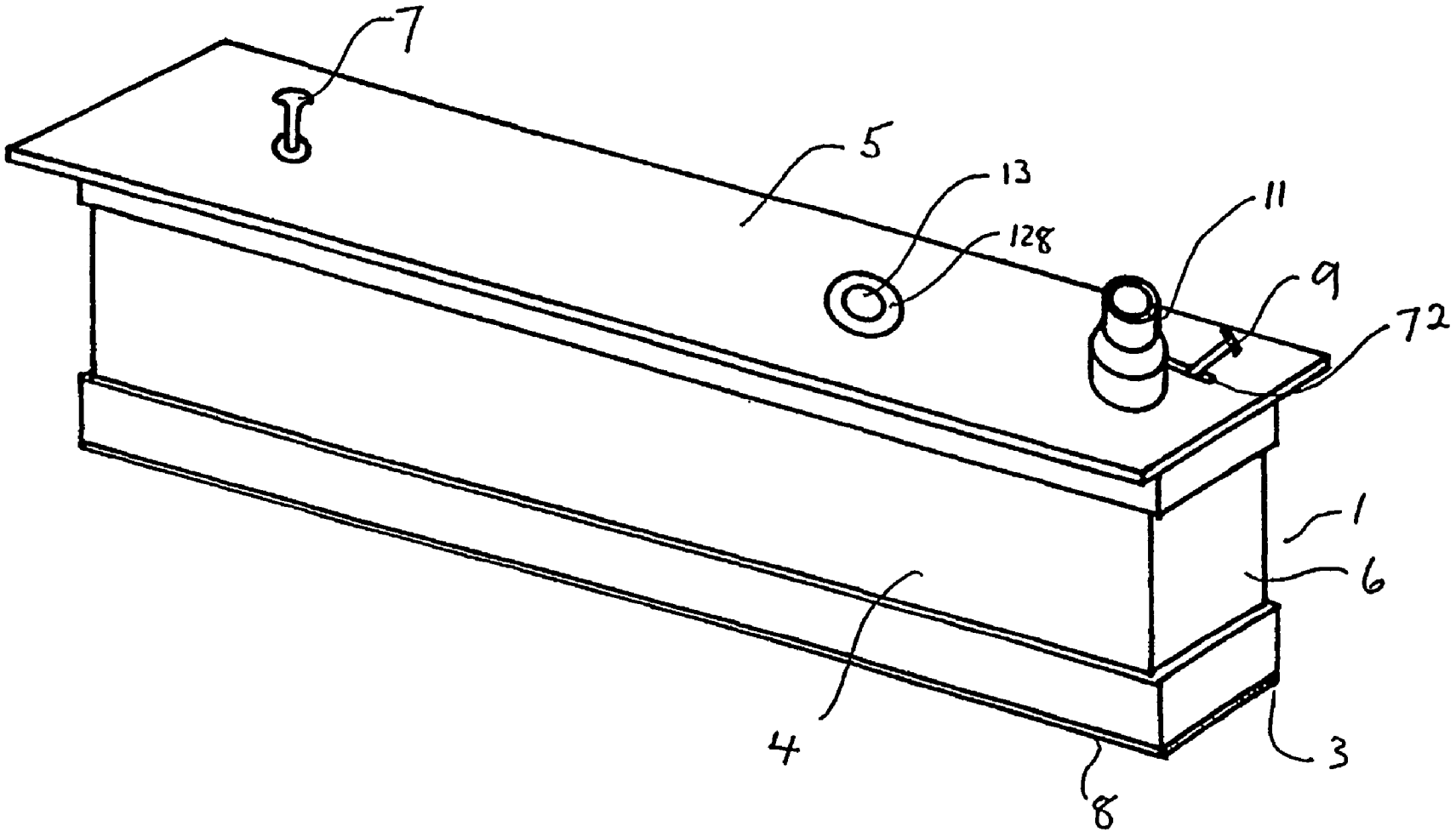
FIG. 1 shows an isometric view of a golf ball teeing device according to the invention.

Referring to FIG. 1, the teeing up device generally designated 1 includes a housing 3 having side walls 4 and end walls 6.

The upper part of the housing is provided with a platform 5 upon which a golfer may stand. A base 8 closes off the bottom of the housing.

The teeing up device would normally be placed in a recess so that the platform 5 sits at ground level.

The upper surface of the platform includes an inlet 11 for golf balls delivered by a feeder tray and track assembly which will be described in more detail hereinafter.

A lever for adjusting the height of a golf ball tee is movable in the slot 72.

Figure 6:
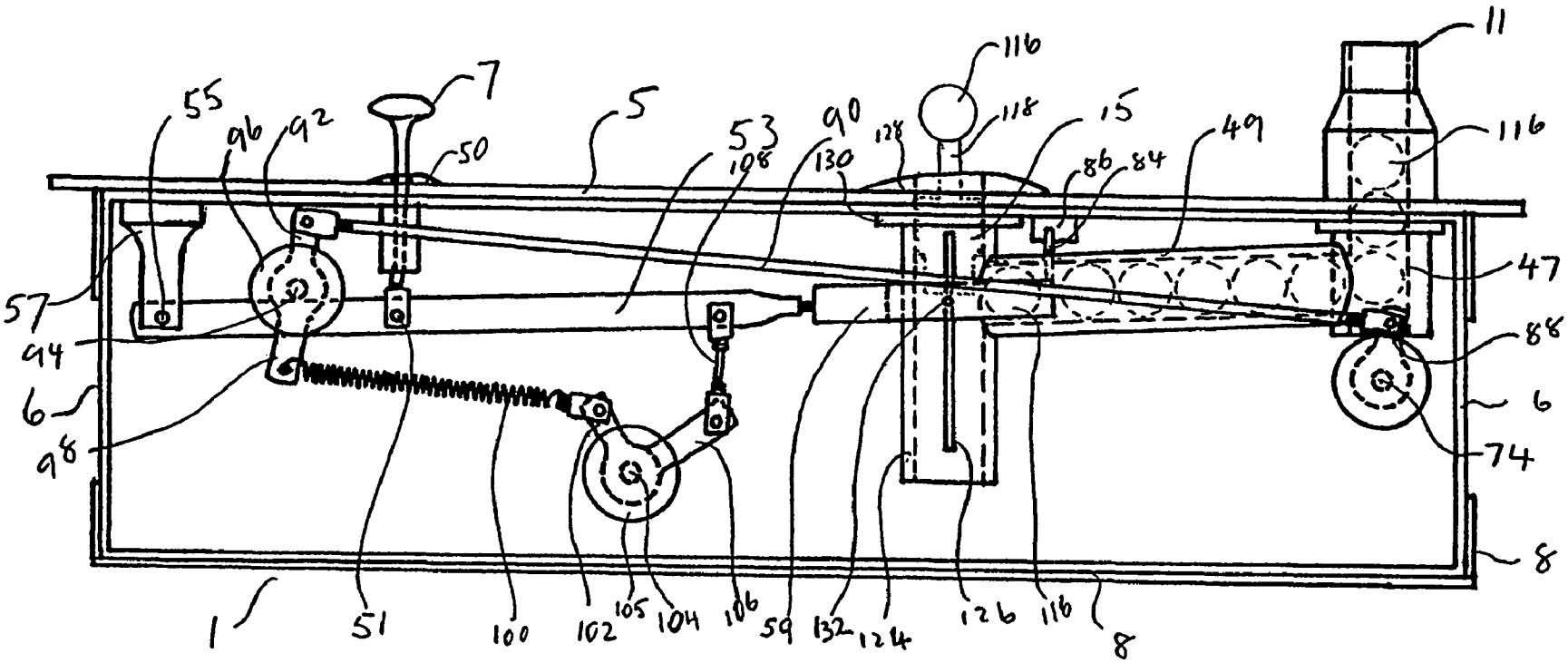
FIG. 6 shows an elevational view of the forward half of the mechanism shown in FIG. 7 taken from the uppermost side of the drawing.

An opening 13 in the top of the platform is provided for allowing a tee to move from below the height of the platform to a point where the tee protrudes above the platform height. Whilst the tee is not shown in FIG. 1, FIG. 6 illustrates the manner in which a tee would protrude above the opening. A surround 128, encircles the opening and forms part of a tubular insert which will be described in more detail hereinafter.

An actuator 7 is provided near one end of the platform remote from the opening 13 so that it does not interfere with a golfer preparing to drive a ball. The location of the actuator 7 is such that a golfer may simply take a small step backwards to depress the actuator to tee up a further golf ball.

Figure 2:
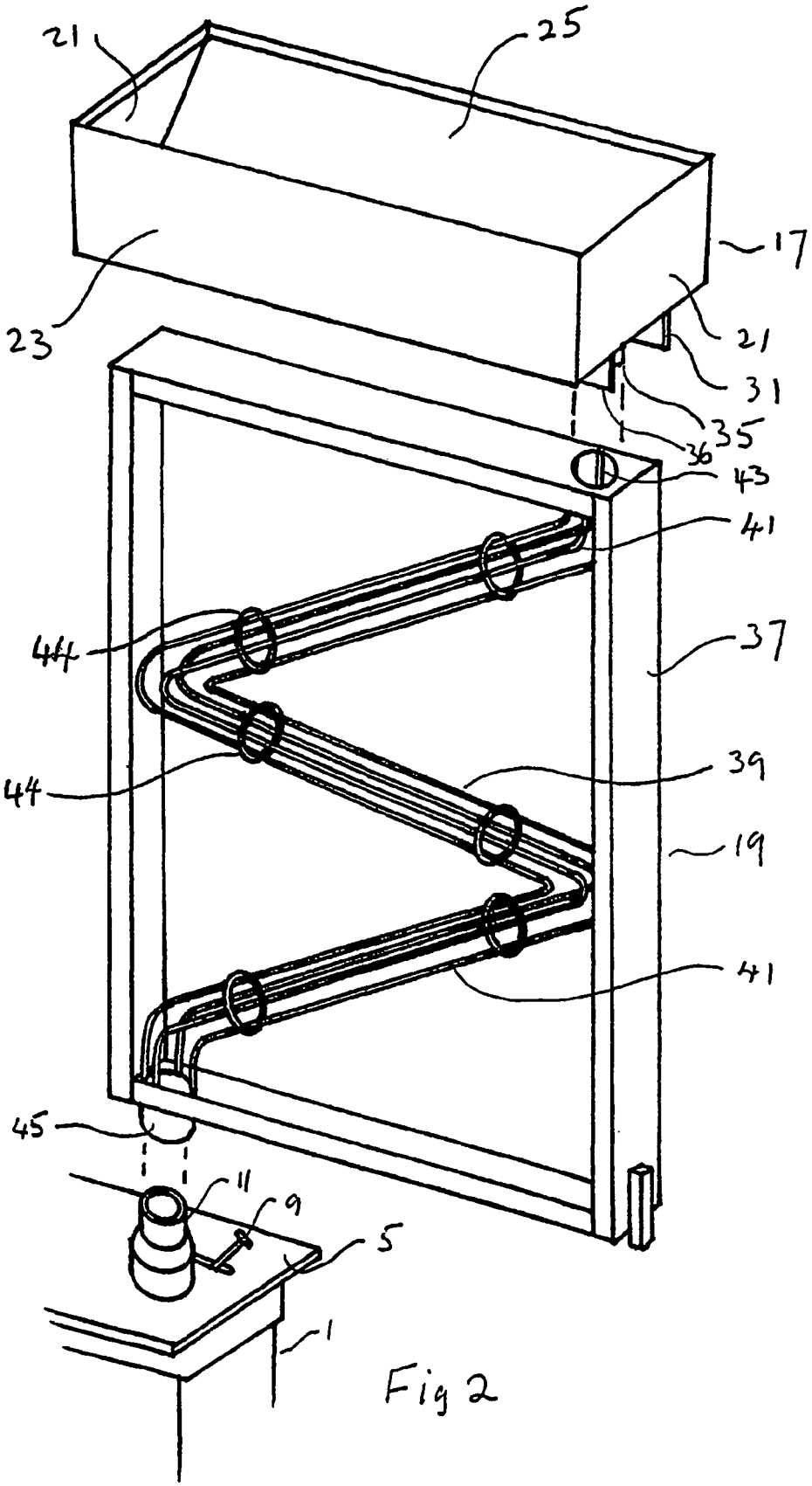
FIG. 2 shows a disassembled isometric view of a feeder tray, trackway and golf ball teeing device according to the invention.
Figure 4:
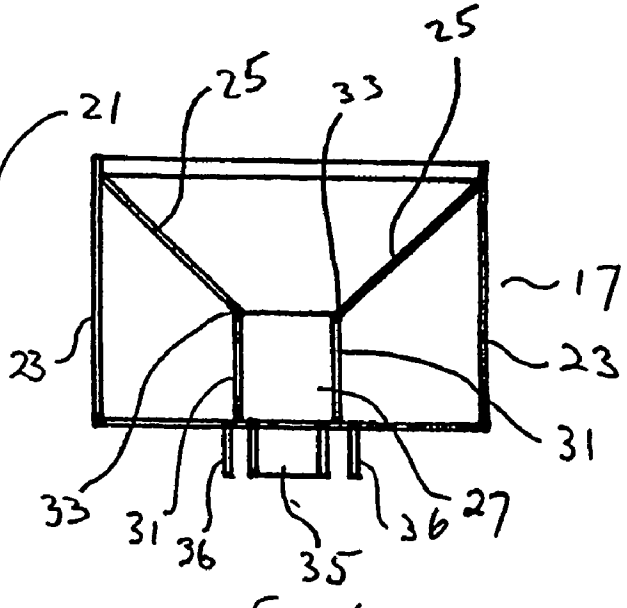
FIG. 4 shows an elevational end view of the feeder tray of FIG. 3.
Figure 3:
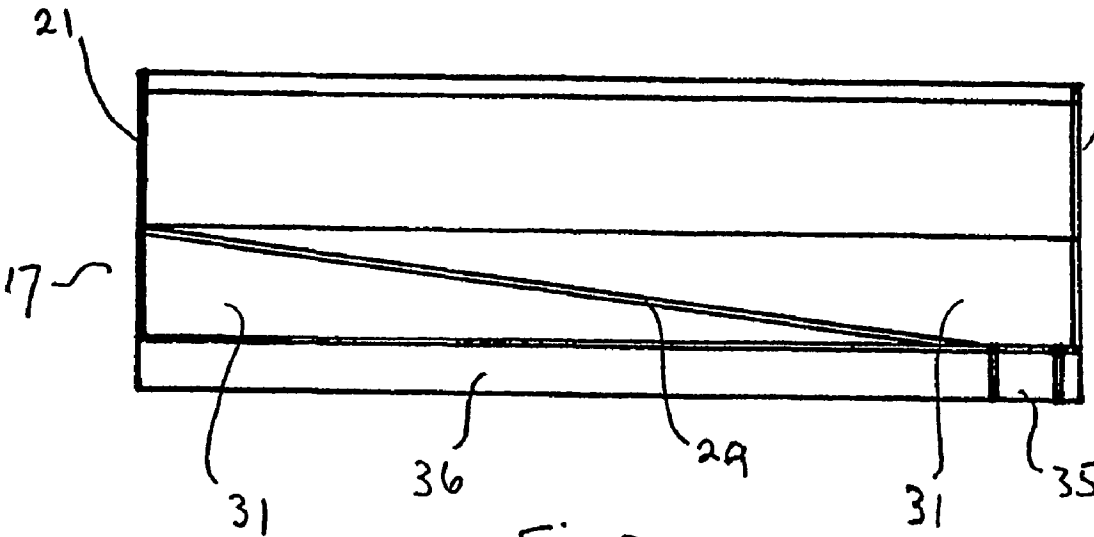
FIG. 3 shows an elevational view of a side of a feeder tray according to the invention.

Referring to FIGS. 2 to 4 of the drawings the delivery system for delivering golf balls single file to the teeing up device comprises a feeder tray 17 and a track assembly 19 which can be fitted together to deliver balls through the inlet 11.

The feeder tray includes end walls 21 and outer side walls 23 giving the feeder tray a rectangular appearance.

Sloping surfaces 25 depend inwardly from the outer side walls to deliver balls to the channel 27 provided therebetween.

The channel has a sloping floor 29 and side walls 31 each joined with the bottom edge of the respective sloping surface 25. The channel slopes in a direction perpendicular to the sloping direction of each of the sloping surfaces 25.

The channel terminates in an outlet 35 for delivering golf balls to the track assembly 19.

Parallel fins 36 run lengthways along the underside of the feeder tray, the spacing of the -fins being such that they snugly straddle the top of the frame 37 of the track assembly when the outlet 35 is fitted into the inlet 43 of the track assembly.

The construction of the feeder tray with the combination of sloping side walls arranged to deliver balls to the channel under gravity has been found to be particularly suitable for delivering balls in single file to the track assembly. A construction for spreading out balls is desirable for reliably delivering the balls in single file to the track assembly after a bucket full of balls has been dumped into the feeder tray.

By comparison the use of a simple delivery device such as a funnel can often result in balls becoming jammed. By spreading the area over which the balls are held over the sloping surfaces of the feeder tray, applicants have found that the incidence of jamming is greatly reduced.

The track assembly itself comprises a number of rods 41 held in place relative to each other by the rings 44. The trackway 39 is elongate so that it can be used to act as a ball storage device. In order to reduce the spatial dimensions of the elongate trackway so that it may be held within the frame 37, it has a zigzag configuration. An added advantage of this zigzag configuration is that it reduces the cumulative pressure of balls pressing against each other under the influence of gravity as they line up in the trackway. The relatively gentle slope of the trackway accordingly reduces ball to ball pressure in each straight section of the trackway compared to an equivalent length of vertical trackway section. Furthermore the bends in the trackway limit the pressure to a single straight section and isolate the pressure from the next straight section. Distribution of pressure in this fashion again reduces the risk of jamming.

The track assembly has an outlet 45 constructed so that it can telescope over the inlet 11 of the teeing up device.

Figure 5:
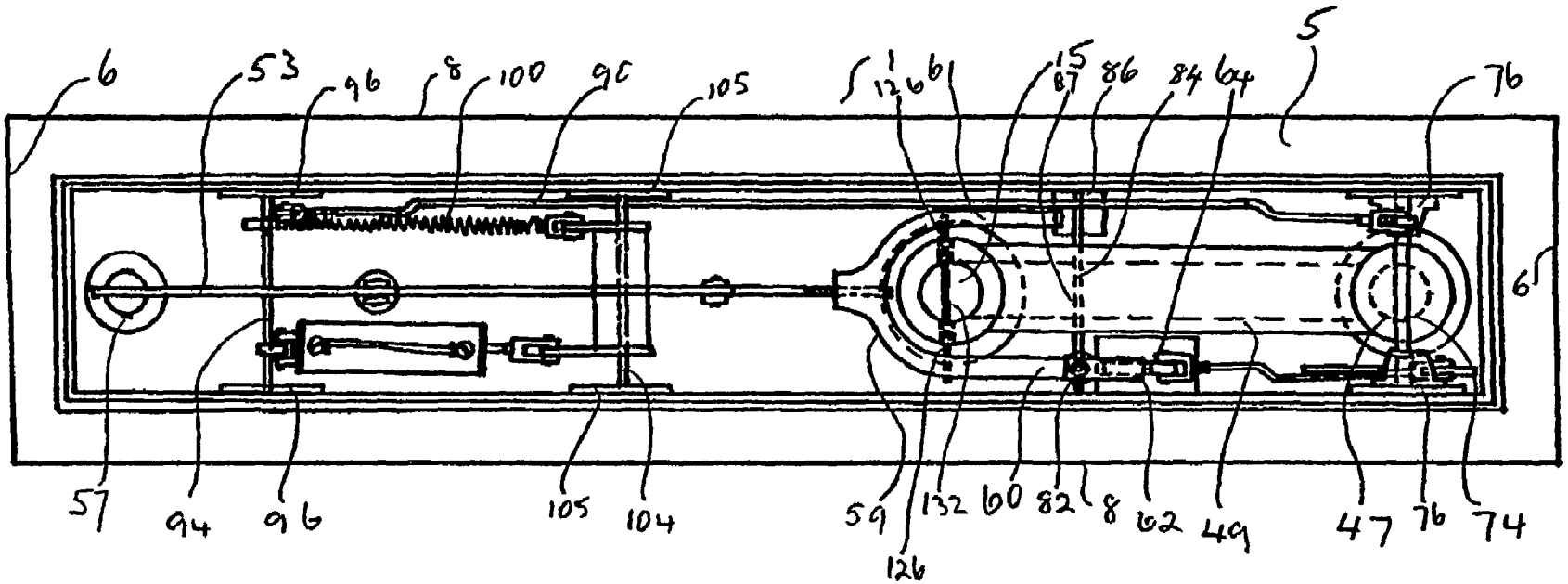
FIG. 5 shows an underneath plan view of a golf ball teeing device according to the invention.
Figure 7:
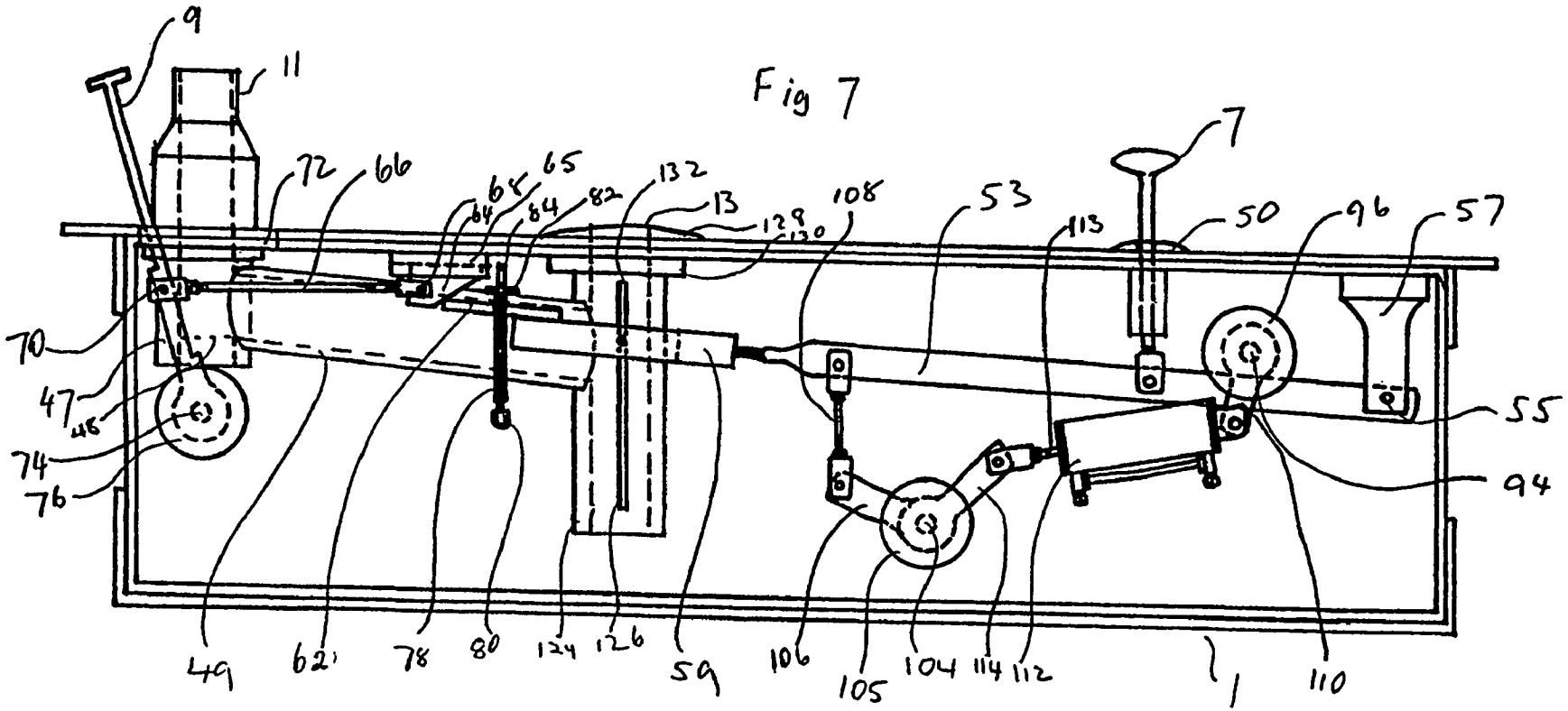
FIG. 7 shows an elevational mirror image of the first half of the mechanism of FIG. 5 taken from the side at the lowermost part of the drawing.
Figure 8:
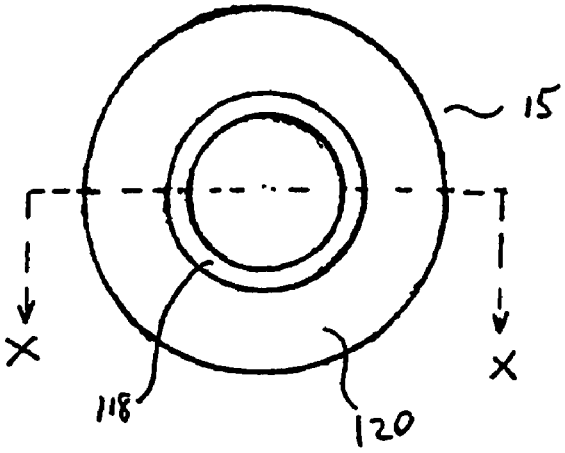
FIG. 8 shows an enlarged plan view of the golf tee shown in FIG. 6.
Figure 9:
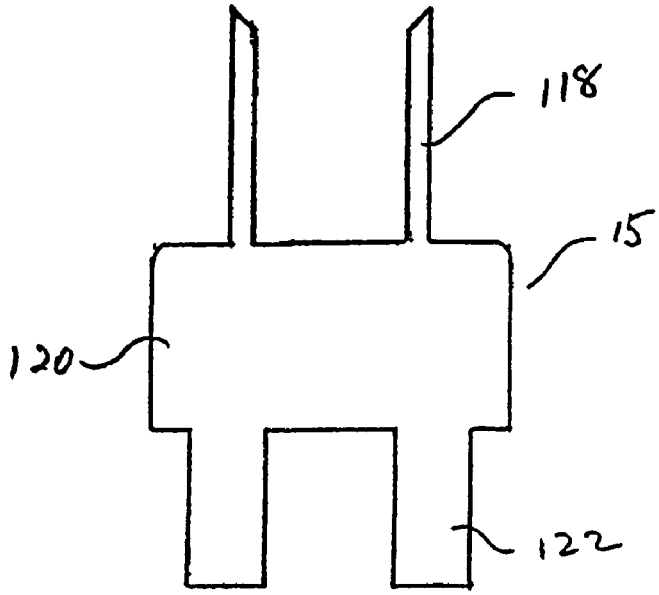
FIG. 9 shows an elevational view of the section X—X of FIG. 8.
Figure 10:
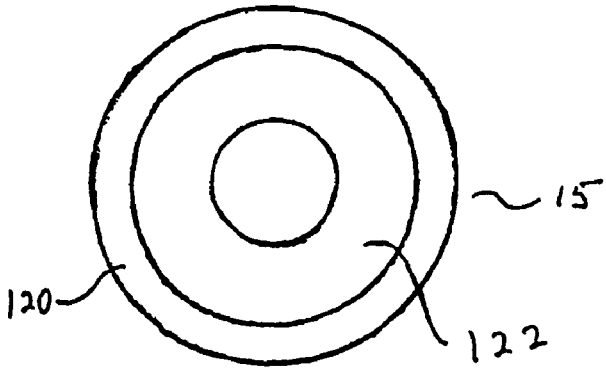
FIG. 10 shows an underneath plan view of the golf tee of FIG. 8.

Referring to FIGS. 5 to 7 of the drawings, the teeing up device shown therein includes a tubular element 47 provided with the previously described inlet 11. The tubular element extends through the platform 5. The tubular element has a floor section 48 to guide balls 116 into the trackway 49. The trackway 49 may itself be a tubular member arranged with a slight slope so that balls continue down the trackway under the influence of gravity.

Control of balls going down the trackway 49 is associated with movement of the actuator 7.

The actuator 7 is slidably retained in the tubular insert 50. The actuator extends to join with the lever 53 via a pivotal connection 51.

The rear end of the lever 53 is pivotally mounted on the post 57 via the rear pivot 55.

The other end of the lever 53 is secured to a horseshoe member 59 having parallel arms 60 and 61.

Arm 60 has an extension 62. The forward edge of the extension abuts the ramp 64.

The ramp 64 is shaped to be slidable in the track member 65 provided on the underside of the platform. A rod 66 pivotally connects the ramp via the pivot 68 and pivot 70 to the height adjustment lever 9.

The height adjustment lever which is movable in the slot 72, is connected to the axle 74. The axle is rotatably mounted in the bearings 76 provided on opposed walls of the housing.

A control mechanism to prevent more than one ball at a time rolling down the trackway 49 comprises a tube 78 mounted on the extension 62. A pin 80 is slidable in the tube and is spring loaded via a spring surrounding the pin and mounted within the tube. The spring loading causes the pin 80 to push upwardly the support 82 provided on the end thereof which in turn pushes upwardly against the plate 84.

A slotted support 86 provided on the opposite wall of the housing guides the other end of the plate which can move up and down in a slot 87 provided across the tubular trackway 49.

The axle 74 also has mounted thereon a rotatable arm 88 pivotally connected to a rod 90. This is pivotally connected to an upper arm 92 mounted on axle 94. The axle 94 is rotatable in the bearings 96 mounted on the opposed side walls of the housing.

The upper arm is connected to a lower arm 98 on the opposite side of the axle. A tension spring 100 extends between and joins the lower arm and an arm 102 mounted on the axle 104.

The axle 104 rotates within bearings 105 mounted on opposed sides of the side walls 4.

A further arm 106 is mounted for rotation on the axle 104. This arm in turn is joined by a connecting rod 108 to the lever 53 via pivotal attachment points.

A further arm 114 is mounted for rotation on the axle 104. This connects via a pivotal join to the piston 113 of a pneumatic cylinder 112. The opposite end of the pneumatic cylinder is joined to the arm 110 for rotation on the axle 94. Means are provided on the pneumatic cylinder to adjust the damping effect provided by the cylinder.

The tee element 15, shown in dotted lines, is slidable in the tubular insert 124 extending through an opening in the platform. It sits upon a pin 132 extending from the arm 62 to the arm 61 of the horseshoe member. The pin extends through and is free to move vertically in elongate slots 126 extending vertically on opposite sides of the tubular insert.

The -insert is secured in place by an integral surround 128 provided on the surface of the platform surrounding the opening 13 and a locking nut 130 secured underneath the platform.

During operation of the device, golf balls are tipped out of a bucket by a golfer into a feeder tray 17. The tray aligns the golf balls in single file along the channel 27 from whence they roll under gravity through the outlet 35 into the inlet 43 of the track assembly.

After traveling through the track assembly, the balls enter the inlet 11 of the teeing up device and move under gravity to the trackway 49 where movement of the balls is controlled by the plate 84.

After a golfer has driven a golf ball from the raised tee 15, he steps backward and pushes the actuator 7 downwards with his foot. This action lowers the horseshoe member 59 which moves the pin 132 downwards and with it the tee 15 sitting on top of the pin.

The extent of the downward movement is such that the tee element is lowered so that the top of the tee element is lined up at a level lower than the bottom of the trackway 49.

The first ball in line in the trackway then moves out of the open mouth of the trackway into the vertically extending tubular insert 124 to drop on top of the tee element 118.

Simultaneously, the lowering of the horseshoe member results in the support for the slidable plate being lowered ie. the support 82 moves down with the extension 62 of the horseshoe arm 60 thereby causing the plate support 84 to move down under the influence of gravity into the slot 87 formed in the upper part of the trackway 49. Thus the plate stops the second ball in line in the trackway 49 from moving along the trackway.

When the pressure on the actuator 7 is released, the tension spring 100 acting on the arm 102 works to rotate the arm 106 counterclockwise as shown in FIG. 6 to raise the lever 53 to the position shown in FIG. 6.

This has the dual effect of raising the tee member so that the tee element 118 protrudes above the level of the platform. As the golf ball is already sitting on the tee element, it is raised with the upward movement of the tee to be moved into position ready to be hit by the golfer.

The pneumatic cylinder acts via the arms 114 and 116 to damp the upward movement of the lever and hence the tee so that the movement is sufficiently smooth as to reduce the likelihood of the golf ball being dislodged from the tee element 118 as it moves upwardly into the hitting position.

The golfer may set the level at which the tee element rises above the platform by adjustment of the lever 9.

For example, movement of the lever shown in FIG. 7 from left to right has the effect of sliding the ramp 64 in the track member 65 to the right through the action of the rod 66 connected to the lever.

As the slope of the ramp abuts against the extension 62, the ramp has the effect of limiting the upward movement of the horseshoe member 59 and hence the tee sitting on the pin 132 connected to the two arms of the horseshoe member. Thus the maximum height of the tee is set by moving the lever 9.

Movement of the lever 9 from left to right also has the effect of rotating the axle 74 in the clockwise direction as seen in FIG. 7. This means that the arm 88 as shown in FIG. 6 pushes the rod 90 from right to left to reduce the tension in the spring 100 by movement of the arm 98. In turn this means the arm 102 by virtue of its attachment to the axle 104 eases off rotational force on axle 104 to allow the arm 106 also attached to the axle 104 to move downwardly slightly with the reduced pressure. This compensates for the limit in the upward movement of the end of the lever 53 when the ramp 64 pushes the extension of the horseshoe member downwardly.

At the same time, the arm 110 also mounted on the axle 94, as shown in FIG. 7, moves, slightly in a clockwise direction. This has the effect of acting through the pneumatic cylinder 112, the arms 114 and 106 and the rod 108 to again produce a slight downward compensating effect on the lever 53 similar to the downward movement obtained with the arrangement of the spring acting through the arm 106.

Thus it can be seen that operation of the tee up device of the invention is very simple in both construction and operation. From the point of view of the golfer, he must simply place the golf balls in the feeder tray, adjust the desired height of the tee and then press down on the actuator 7. After he has driven the first ball he only has to press down on the actuator to present a new ball which is automatically teed up at the same height as he set for the previous ball.

As the mechanism does not require any external power source it can be operated in any location. Furthermore, the basic simplicity of the construction has substantial advantages in terms of cost of manufacture and the ability to vary the height of the tee is a significant advantage for accommodating a range of golfers with different preferences.

While the device has been described as one which can be operated without any external power source, this does not exclude the possibility that the device may be operated with ancillary equipment which may itself be operated electrically or in some other way. For example, the delivery system for the golf balls may involve electrical or electronic equipment. A number of feeder lines may be used to direct golf balls from a central facility for feeding golf balls to a number of individual teeing up devices according to the invention. Each tee up device may be associated with means for counting the number of golf balls which have been set up on a tee by a golfer. In association with this, a central operator may have the capacity to select the -number of golf balls delivered to each device in accordance with payment or an order by the golfer. Alternatively or additionally the golfer himself may have this capacity through a control mechanism and payment mechanism associated with each tee up device It may even be associated with a credit card facility which reads a credit card and automatically debits the card in accordance with the amount of golf balls counted by the tee up device.

Figure 11:
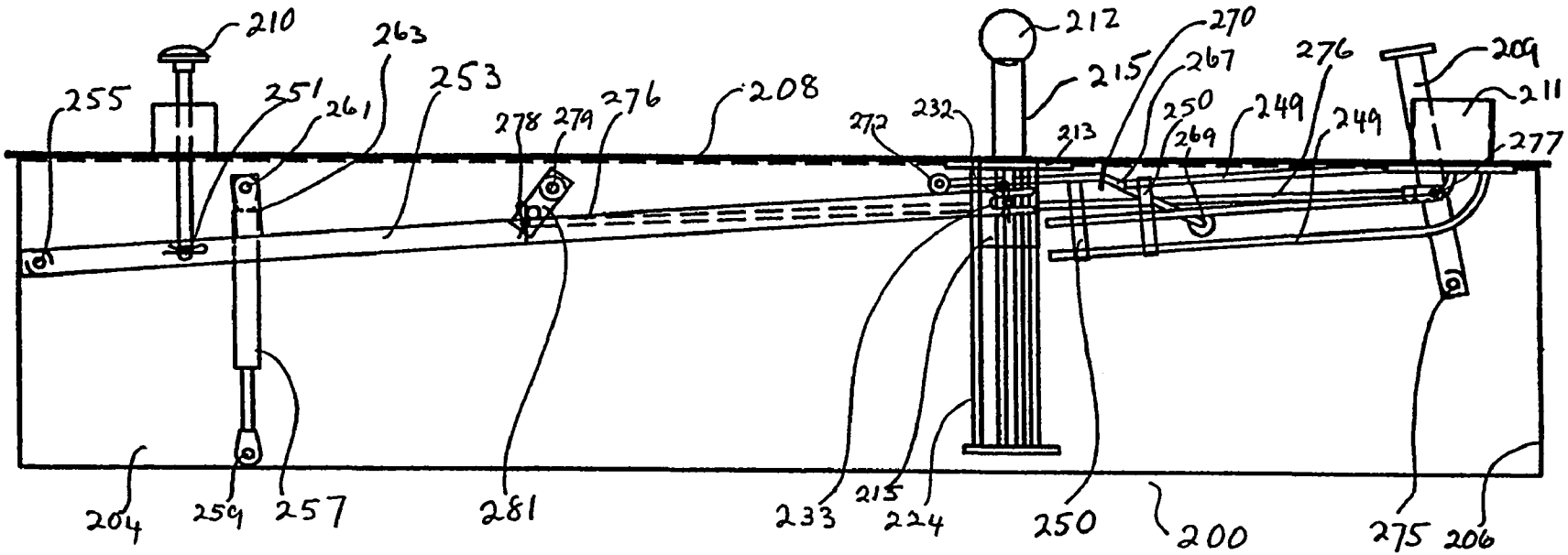
FIG. 11 shows an elevational view of an alternative form of golf ball teeing device according to the invention with side panel removed.
Figure 12:
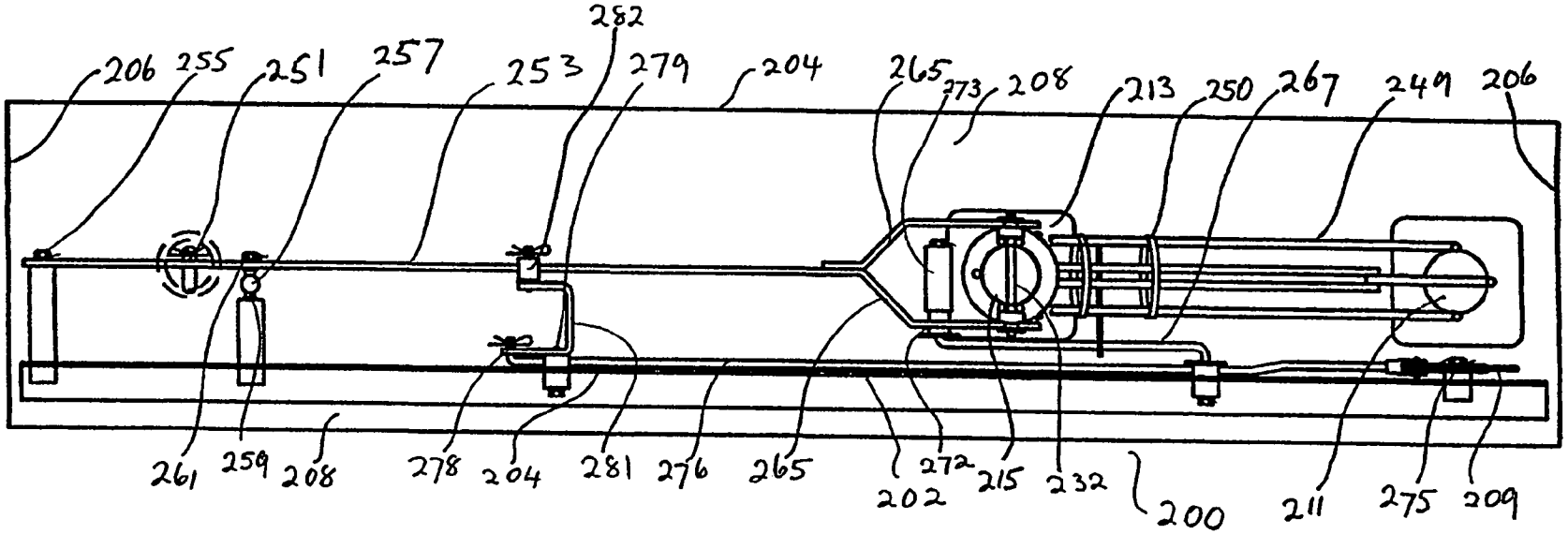
FIG. 12 shows an underneath plan view of the golf ball teeing device of FIG. 11.

Referring to FIGS. 11 and 12, the teeing up device generally designated 200 is constructed broadly along the lines of the device described with reference to FIGS. 1 to 10. The changes in components largely represent a simplification of those already described with reference to these Figures.

Thus the teeing up device 200 includes a housing 202 with side walls 204 and end walls 206. A platform 208 which forms part of the housing is mounted atop the side and end walls. As will be explained hereinafter, one of the side walls 204 acts as a support for a number of the components constituting the working elements of the tee up device.

A lever 209 for providing variable height adjustment of the tee 215 protrudes from inside the housing through the platform to provide ready access to a user.

Similarly, a foot operated actuator 210 protrudes through the platform 208 for the purpose of initiating reloading of a golf ball 212 on the tee whenever the actuator is depressed by an operator's foot.

An inlet 211 for golf balls leads to a trackway 249 for delivering golf balls to the tee 215.

The trackway comprises a number of rods joined together by the two collars 250. The uppermost rod of the trackway terminates at a position shorter than the other rods forming the trackway to leave room for the stop member 270 to move into position as will be described hereinafter.

The end of the trackway is adjacent the vertically extending tubular cage 224 made up of linear vertically extending rods. The arrangement is such that the bottom of the tee 215 can move up and down in the trackway to such an extent that the top of the tee aligns with the bottom of the trackway 249 to allow a golf ball to roll under gravity onto to the top of the tee within the tubular cage when the actuator 210 is depressed.

A pin 232 extending through a lower portion of the tee 215 is held in slots 233 which are formed in both arms of the yoke 265.

The actuator is mounted by means of a pivotal connection 251 to the lever 253 extending generally laterally within the housing. In turn, the lever is mounted by a pivotal mount 255 to the side wall of the housing.

The lever 253 is biased to the position shown in FIG. II by the pneumatic cylinder 257. The pneumatic cylinder is mounted by the pivotal mount 259 to the side wall of the housing. The opposite end of the pneumatic cylinder has a pivotal connection 261 to the leg 263 extending at right angles from the lever.

Ball stop means comprising a rod 267 connected by the pivotal mount 269 to a side wall of the housing include a stop member 270, and a roller 272. The roller is adapted to sit atop one side of the pair of arms of the yoke 265 and a weight 273 fitted next to the roller is providing for urging the ball stop means to move downwardly when the lever 253 moves down. Thus the stop member 270 also moves down to a position where it blocks movement of golf balls in the trackway already behind the stop member. The stop member is positioned so that the distance between it and the position taken up by the bottom of the tee shown in FIG. 11 is approximately the width of a golf ball.

Height adjustment of the tee is by means of a height adjustment assembly comprising the rod 276. This is pivotally joined to the lever 209 at one end by the pivot join 277 and at the other end by the pivot join 278 to the U-shaped bar 281. In turn, the Ushaped bar is pivotally mounted by the pivot mount 279 on the side wall of the housing. The opposite side of the U-shaped bar includes a roller 282 arranged to sit atop the lever 209 and acts as a stop against upward movement of the lever beyond the level of the stop. It can be seen that the height of the roller can readily be adjusted by moving the lever 209. This in turn sets the maximum height to which the lever 209 may reach in lifting the golf ball on the tee above the platform.

In normal operation of the teeing device illustrated in FIGS. 11 and 12, a line of golf balls are supplied through the inlet 211 to the trackway 249. These golf balls roll under gravity until the foremost golf ball bumps against the bottom of the tee 215 and is held there for such time as the tee remains in the upward position illustrated in FIG. 11.

After a golfer has teed off the golf ball 212 he actuates the tee to take up a new golf ball by pressing down on the actuator 210 with his foot. This pushes the lever 253 downwardly so that the top of the tee 215 lines up in a position where the foremost golf ball in the trackway may roll downwardly to rest on top of the tee.

As the lever 253 moves downwardly the weight 273 pushes the rod 267 down under the influence of gravity and the stop member moves down to prevent the next golf ball in line from moving downwardly at the same time as the foremost golf ball rolls onto the tee.

As the pressure on the actuator 210 is released the pneumatic cylinder 257 acts to push the lever 253 upwards in a controlled fashion thereby pushing the tee with golf ball mounted thereon up through an opening 213 in the platform to present the golf ball. in the manner illustrated in FIG. 11. At the same time the upward movement of the lever 253 causes the ball stop means to lift the stop member 270 out of registry with the trackway allowing the next ball to roll down against the bottom of the tee ready for the sequence to be repeated at will.

Figures 13, 14:
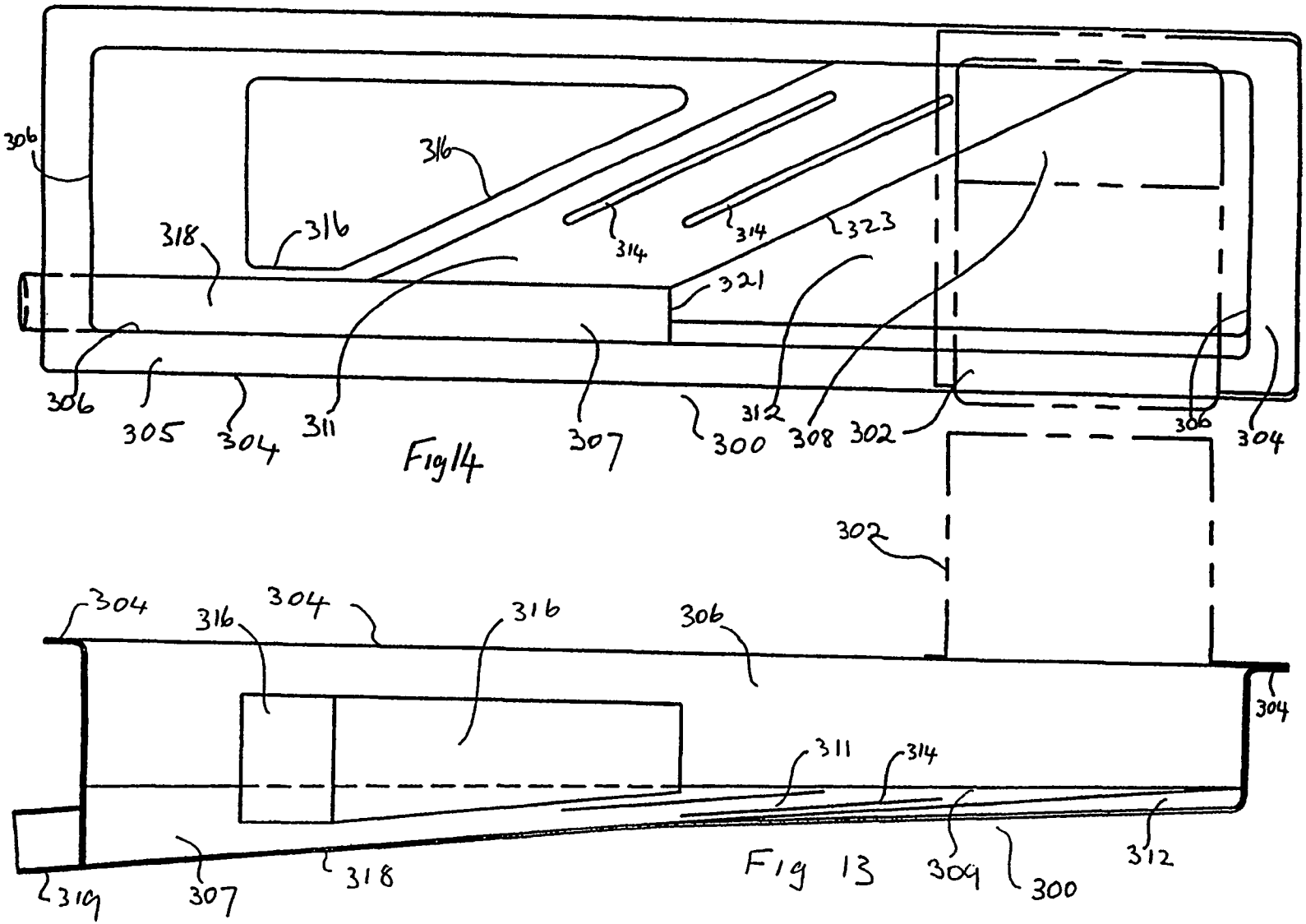
FIG. 13 shows an elevational view of an alternative feeder tray according to the invention.
FIG. 14 shows a top plan view of the feeder tray of FIG. 13 according to the invention.
Figure 15:
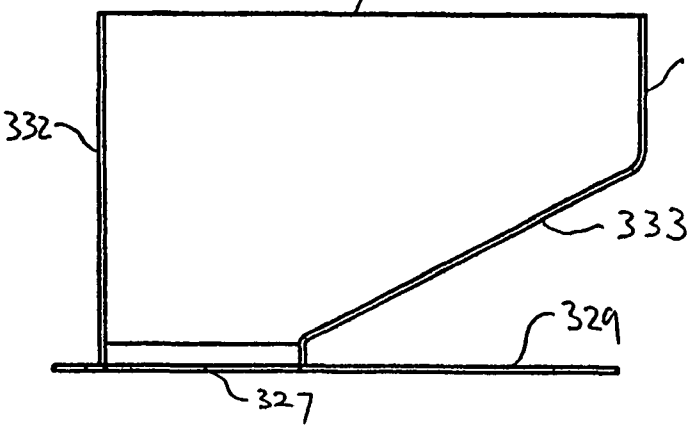
FIG. 15 shows an elevational view of a hopper for use with the feeder tray of FIG. 13.

Golf balls may be provided in single file to the opening 211 from a trackway fed by the feeder tray shown in FIGS. 13, 14 and 15.

The feeder tray comprises a hopper 302 and an alignment tray 304.

The alignment tray has a circumferential lip 305 which may serve as a surface for mounting the feeder tray on a rigid frame. The alignment tray may be made from any suitable material such as metal or plastic. Where large numbers of alignment trays are required it is anticipated that the alignment tray may be injection moulded in a suitable plastics material such as a reinforced plastic or a high density polyethylene.

The alignment tray includes side walls 306 and an exit chute 307. The exit chute includes an outlet 319 at the forward end of the chute. The alignment tray floor 309 has a ball entry area 308. This receives balls which have been funneled through the hopper 302. The tray floor which extends from the ball entry area to the exit chute has a shallow sloped region 311 and a more steeply sloped region 312.

The shallow sloped region includes ball flow control means to impede the rate of travel of balls which happen to spill out over the shallow sloped region. The ball flow control means take the form of ribs 314. It can be seen that the ribs extend in a direction which makes an acute angle with the direction of the exit chute.

A deflector wall 316 running along one side of the shallow sloped region and along part of the length of the exit chute is also provided. It has been found that the combination of deflector wall and ribs arranged in this manner helps to reduce the likelihood of balls which spill over onto the shallow sloped region becoming jammed.

The width of the exit chute is approximately the width of a single golf ball. The exit chute floor 318 extends from a level at the rearward end of the chute which is substantially the same as the level of the alignment tray floor at a downward angle with respect to the alignment tray floor. Thus golf balls rolling into the chute travel in single file down the chute to the outlet 319.

The rearward end of the chute meets with the line of join 323 between the shallow and more steeply sloped floor portions.

Figure 16:
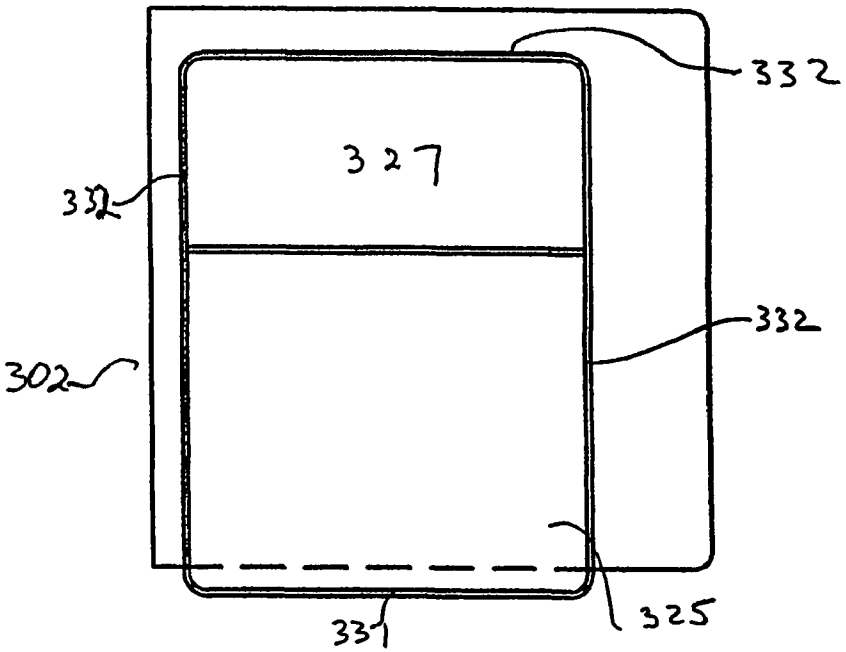
FIG. 16 shows a top plan view of the hopper of FIG. 15.
Figure 17:
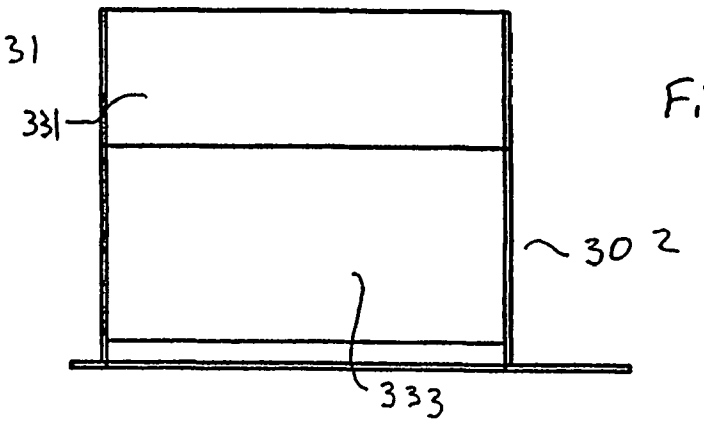
FIG. 17 shows an end elevational view of the feeder tray of FIG. 15 after it has been rotated through 90°.

The hopper used to feed golf balls to the ball entry area of the alignment tray is shown in more detail in FIGS. 15, 16 and 17. It may be formed as a separate component as is shown in the drawings or may be permanently fixed to the alignment tray. It comprises a wide-mouthed inlet 325 and a construction which funnels balls to an outlet 327 for delivering balls to the ball entry area of the alignment tray. A flat mounting plate 329 is suitably provided on the bottom of the hopper in order that it can readily mounted in the fashion illustrated in FIGS. 13 and 14 over the top of the alignment tray.

The funneling effect for the hopper is provided by vertical walls 332 on three sides of the hopper and a combination of the vertical walls 331 and ramped wall 333 on one side of the hopper.

Of course it is to be appreciated that the feeder tray illustrated and described with respect to FIGS. 13 to 17 may be used in association with either of the teeing up devices described hereinbefore. Balls provided in single file through the outlet 319 may be fed by a trackway to the inlet of a teeing device.

It is to be understood that the word comprising as used throughout the specification is to be interpreted in its inclusive form i.e. use of the word comprising does not exclude the addition of other elements.

It is to be understood that various modifications of and/or additions to the invention can be made without departing from the basic nature of the invention. These modifications and/or additions are therefore considered to fall within the scope of the invention.

What is claimed is:

1. A feeder tray for balls comprising:

a hopper having an open mouth arranged to funnel balls dumped through the open mouth through a restricted outlet to drop into a ball entry area forming part of the floor of an alignment tray;

a tray floor for the alignment tray sloping downwardly from the ball entry area to a ball delivery area;

ball flow control means on the tray floor between the ball entry area and ball delivery area;

a downwardly sloping exit chute at a lower level than the ball delivery area and abutting the ball delivery area arranged to receive balls from the ball delivery area over at least a portion of the length of the abutment between the ball delivery area and exit chute; and an exit outlet provided at the lowermost end of the exit chute shaped so as to allow single file passage of balls coming down the exit chute through the exit outlet, wherein the ball flow control means are arranged to slow the rate of travel of a proportion of balls rolling down the tray floor into the exit chute, the exit chute has a forward end at which the exit outlet is located and a rearward end, and the downward slope of the tray floor nearer the vicinity of the forward end is less than the downward slope at or near the rearward end.

2. The feeder tray of claim 1 wherein the ball flow control means comprises a plurality of ridges on the tray floor, the direction of the ridges generally making an acute angle with the direction of the chute.

* * * * *